US006976752B2

(12) United States Patent
Parish et al.

(10) Patent No.: US 6,976,752 B2
(45) Date of Patent: Dec. 20, 2005

(54) INK JET PRINTER WITH RESISTANCE COMPENSATION CIRCUIT

(75) Inventors: George Keith Parish, Winchester, KY (US); Kristi Maggard Rowe, Richmond, KY (US); John Glenn Edelen, Versailles, KY (US)

(73) Assignee: Lexmark International, Inc., Lexington, KY (US)

( * ) Notice: Subject to any disclaimer, the term of this patent is extended or adjusted under 35 U.S.C. 154(b) by 108 days.

(21) Appl. No.: 10/694,697

(22) Filed: Oct. 28, 2003

(65) Prior Publication Data

US 2005/0088465 A1 Apr. 28, 2005

(51) Int. Cl.[7] ..... B41J 2/05
(52) U.S. Cl. ..... 347/57
(58) Field of Search ..... 347/5, 9, 10, 12, 347/14, 19, 20, 47, 56, 57, 61, 62, 63, 65

(56) References Cited

U.S. PATENT DOCUMENTS 4,251,824 A 2/1981 Hara et al.
5,163,760 A * 11/1992 Nardozzi ..... 400/120.07
5,281,980 A 1/1994 Kishida et al.
5,454,767 A 10/1995 Clausen et al.
5,497,174 A 3/1996 Stephany et al.
5,526,027 A * 6/1996 Wade et al. ..... 347/14
5,677,577 A 10/1997 Barbehenn et al.
5,682,185 A 10/1997 Wade et al.
5,767,872 A * 6/1998 Scardovi et al. ..... 347/17
5,786,837 A * 7/1998 Kaerts et al. ..... 347/190
5,844,581 A 12/1998 DeJoseph et al.
5,943,069 A 8/1999 Kamiyama et al.
6,183,056 B1 2/2001 Corrigan et al.
6,318,831 B1 11/2001 Baker
6,409,315 B2 6/2002 Komuro
6,431,685 B1 8/2002 Misumi
6,439,678 B1 * 8/2002 Norton ..... 347/9
6,755,495 B2 * 6/2004 Beck et al. ..... 347/12
2003/0142156 A1 7/2003 Sato

FOREIGN PATENT DOCUMENTS

JP 04183005 7/1993
JP 2001207040 1/2003

* cited by examiner

*Primary Examiner*—Anh T.N. Vo
(74) *Attorney, Agent, or Firm*—Luedeka, Neely & Graham, P.C.

(57) ABSTRACT

An ink jet printer includes a printhead control circuit that produces printhead command signals based on data signals provided by the printer. A power circuit actuates ink ejectors in response to the printhead command signals and includes a plurality of compensation circuits. Each ink ejector is associated with a single compensation circuit and each compensation circuit includes a number of switches connected in parallel with each other. Each switch in a single compensation circuit is connected to actuate a single ink ejector when the switch is turned on. The compensation circuits adjust their internal resistance by turning on more or less switches and thereby compensate for changing effective parasitic resistance of the power lines.

19 Claims, 4 Drawing Sheets

INK JET PRINTER WITH RESISTANCE COMPENSATION CIRCUIT

FIELD OF INVENTION

The present invention relates to an ink jet printer having a circuit that compensates for effective or apparent changes in the parasitic resistance of the ink-jet printhead, and particularly relates to an inkjet printer having a compensation circuit that reduces resistance when the effective parasitic resistance increases.

CROSS REFERENCED TO RELATED APPLICATIONS

None.

BACKGROUND

In an inkjet printer, it is important to actuate the ink ejector with the appropriate voltage and current. However, during the operation of the printer, the effective or apparent parasitic resistance changes and this change could change the voltage and the current supplied to the ink ejector. One example of this phenomenon occurs when multiple ejectors attached to the same power line are fired or actuated simultaneously, which means that multiple ejectors are on during a particular time interval. There is a parasitic resistance associated with the power lines leading to each of the ejectors. When multiple ejectors are fired at the same time, the current passing through the power line prior to reaching the ejectors increases proportionally to the number of ejectors fired. The increasing current causes an increased voltage drop across the power line and thus reduces the voltage supplied to each ejector. Regardless of the type of ink ejectors that are used, a reduced voltage supplied to the ink ejectors may have negative effects on their operation. These negative affects may reduce print quality. For example, in inkjet printers that use heater resistors to eject ink, the heat produced by the heater resistor depends on the voltage applied to the heater resistor. Thus, when multiple ejectors attached to the same power line are actuated simultaneously, the heat produced by each ejector is reduced compared to the heat that would be produced if the ejector were actuated alone. (Actuated means "turned on").

Other changes in the parasitic resistance of an ink jet printer may also occur due to temperature changes in the environment or changes in the circuit over time. These changes in the parasitic resistance, whether effective or actual, will also change the operational characteristics of the printer and may reduce print quality.

SUMMARY

To address the foregoing problems and other problems associated with ink jet printers, the present invention provides a printhead for an ink jet printer that is responsive to signals such as power, control and data signals. The power signals typically provide power to the printhead ejectors and may also be switched on and off to provide an addressing a function. The control signals typically include such things as a load signal, clock signal, a reset signal and similar types of signals that do not directly relate to the data or image that will be printed. The data signals correspond to the object that will be printed and typically include multiple dimensions of address signals.

The printhead includes a printhead housing and a plurality of ink ejectors disposed in the printhead housing. When actuated, the ink ejectors eject ink for printing purposes. A power circuit is provided and it selectively applies power to actuate the ink ejectors and eject ink for printing purposes. A control circuit receives the data signals and responds to them by controlling the operation of the power circuit and thereby controls the actualization of the ejectors based on the data signals. The power circuit includes a compensation circuit that is operated under the control of the control circuit. The compensation circuit reduces the resistance in the overall power circuit in response to the control signals so that the resistance of the compensation circuit is reduced in response to predetermined conditions of operation.

For example, in one embodiment the compensation circuit reduces the resistance of the power circuit in response to a predetermined pattern of data signals. For example, the compensation circuit may include first and second switches each having internal resistances and each being connected to actuate the same ink ejector when the switch is turned on. The first and second switches are connected in parallel with each other, and the control circuit is interconnected with the two switches to control the operation of the switches. That is, the control circuit turns the switches on and off. To actuate an ink jet, the control circuit either turns the first switch on or turns the first and second switches on. The switches are connected in parallel so that the resistance of a compensation circuit is reduced by switching on both the first and second switches. In one embodiment, the control circuit turns on one switch when the data signals indicate that only one ink ejector within a defined group of ink ejectors is required to be actuated within a predetermined time interval. When more than one ejector in a group is active (turned on), the controller activates both switches.

The number of switches connected in parallel with each other and connected to a particular associated ink ejector may vary depending upon the application. For example, if a particular printhead is designed to simultaneously actuate a maximum of eight ink ejectors all of which are connected to the same power signal, it may be desirable to connect eight switches to each ink ejector. If only a single ink ejector will be actuated in a particular group of ink ejectors powered by a particular power signal, then the control circuit may actuate only one of the eight switches to actuate the ink ejector. Since only one ink ejector is being fired, the current in the power lines carrying the particular power signal is relatively small and thus the effective parasitic resistance will be small. Thus, it is not necessary to reduce the resistance in the circuit that fires the ink ejector.

However, for example, if four ink ejectors are actuated simultaneously, the controller may actuate each of the ink ejectors by turning on four switches, for a total of sixteen switches. Since each ink ejector is powered through four parallel switches, the resistance of the switching circuit is reduced as compared to powering the ejector through only one switch. Thus, the reduced switching resistance compensates for the increased effective parasitic resistance created by firing multiple ink ejectors simultaneously. In this example, the number of switches that actuates on for each active ink ejector may be equal to the number of ejectors that will be actuated in a particular group. However, it is not necessary that there be an actual one-to-one correspondence between these numbers. For example, a circuit might provide three switches for each ink ejector and one switch would be used when the total number of the active ejectors in the group is two or less, two switches would be used when the total number of active ejectors in the group is 3 or 4, and three switches would be used when the total number of active ejectors is five or more. Again, these examples illustrate that the number of switches that are actuated to fire a single ink ejector may be proportional to the total number of active ink ejectors in a group of ejectors associated with a particular power signal.

The number of switches that are used to actuate a single ink ejector may also be varied depending on factors other than the number of ink ejectors that are being actuated within a defined group. For example, the control circuit may also monitor the temperature of the printhead, particularly the electronic chip in the printhead, and change the number of switches used to actuate a single ink ejector depending upon the temperature. As the temperature increases, parasitic resistance increases and more switches may be used to actuate individual ink ejectors. The increased number of switches reduces the resistance of the circuit and compensates for the increased parasitic resistance. Likewise, the age of the printhead, or the number of ink droplets ejected, may be determined, and the number of activated switches may be adjusted based on these parameters.

In accordance with a more particular embodiment of the present invention a printer includes a main printer assembly including printer electronics, a media carrier, and a printhead carrier. The printer electronics produces M number of power signals, and also produces control signals and data signals. The data signals correspond to an object that will be printed and they include a plurality of address dimensions. Preferably the data signals include at least Y number of first dimension signals and Z number of second dimension signals. A circuit, such as a tab circuit, is connected to receive the power signals, control signals and data signals from the printer electronics, and a printhead is mounted on the printhead carrier and is connected to the circuit. The printhead receives the power signals, the control signals and data signals, and ink ejectors are disposed in the printhead for ejecting ink. Each ink ejector is identified with a unique combination of power signals, first dimension signals and second dimension signals, and each power signal is associated with, and provides power to a unique group of ejectors. The printhead control circuit is disposed in the printhead and receives at least the data signals, and logic within the the printhead control circuit produces printhead command signals based on the data signals. A power circuit actuates the ink ejectors in response to printhead command signals, and the power circuit includes compensation circuits that receive the printhead command signals. Each ink ejector is associated with a single compensation circuit and each compensation circuit includes X number of switches that are connected in parallel with each other. Each switch in a single compensation circuit is connected to actuate its associated ink ejector when the switch is turned on, and each compensation circuit responds to the printhead command signals to actuate a particular number of switches in the compensation circuit to actuate the associated ink ejector and thereby eject ink.

The logic of the printhead control circuit preferably determines the number of switches to be turned on in a predetermined time interval in a particular compensation circuit based upon (1) the particular power signal that is associated with the ink ejector connected to the particular compensation circuit, (2) the particular unique group of ink ejectors associated with the particular power signal, and (3) the number of ink ejectors within the particular unique group that are required by the data signals to actuate within the predetermined time. For example, within a particular group of ink ejectors associated with a particular power signal, if K number of ink ejectors are required to be actuated by the printhead command signals, then K number of switches may be used to actuate the ink ejector. Alternatively, the number of switches used to actuate the ink ejector may be proportional to the number of active ink ejectors, but not equal to the number of active ink ejectors. (An active ink ejector is one that is required to turn or be actuated by a particular set of printhead command signals.) As in prior embodiments, the control circuit may select a number of switches to actuate an ink ejector based on factors other than the number of ink ejectors within a group to be actuated. For example, the number of switches that are turned on may depend upon the measured temperature of the electronics on the printhead or other environmental factors.

In one specific embodiment, the power circuit will include M power lines for connecting groups of ink ejectors to the power signals. The control logic will comprise Q groups of logic gates, each group being controlled by combinations of the data signals. There are at least Q ink ejectors arranged into M groups of ink ejectors, and the power circuit comprises Q groups of switches where each group of switches is connected to and controlled by one of the groups of logic gates. Each ink ejector is connected to a single group of switches, and each switch in a group will actuate the single ink ejector to which it is connected.

The combinations of data signals that control logic gates may include such a logical combinations as "And", "Or", "Nor", and "Nand" combinations of signals, and "Counts" of signals. For example, a counter may be employed to count the number of ink ejectors within the defined groups that will be active. Depending upon the count, the counter will produce different outputs that may be applied to the inputs of other logic gates such as "And and/or "Or" gates. The other input of the gate may be a particular data signal, such as a particular address in one of the address dimensions. Thus, in this example, the ink ejector will be actuated when the data signals include a particular address and a particular count of active ink ejectors is determined.

BRIEF DESCRIPTION OF THE DRAWINGS

The present invention may best be understood by reference to the following detailed description of illustrative embodiments when considered in conjunction with the drawings in which.

DETAILED DESCRIPTION

Figure 1:
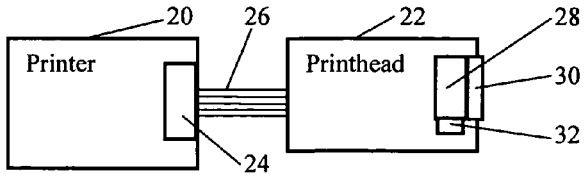
FIG. 1 is a block diagram of a main printer assembly and printhead.

Referring now to the drawings in which like reference characters designate like or corresponding parts throughout the several views, there is shown in FIG. 1 a printer assembly 20 and printhead 22 illustrating the broad context of the present invention. The printer assembly 20 represents the main body of a typical ink jet printer and it would include a media carrier, a printhead carrier, a housing, a power supply, interconnections for external devices, and an electronics module 24 that connects to external devices and also connects through a tab circuit 26 to the printhead 22. The printhead 22 includes an electronics module 28 that is typically formed on one or more integrated circuits or chips. The electronics module 28 is connected to a plurality of ink ejectors 30 that are disposed on of the printhead 22 for applying ink to a media. In some embodiments, the ink ejectors 30 may be built into or integrated into the electronics module 28. For example, the ink ejectors 30 may be built on the same chip as the electronics module 28. The electronics module 20 includes sensors 32 for detecting conditions related to the electronics module 28 such as voltages, currents, and temperatures of the electronics module 28 and/or other parts of the printhead 22. The module 28 (or 24) also monitor parameters related to the condition of the printhead including age, time of operation, and quantity of ink ejected.

Figure 2:
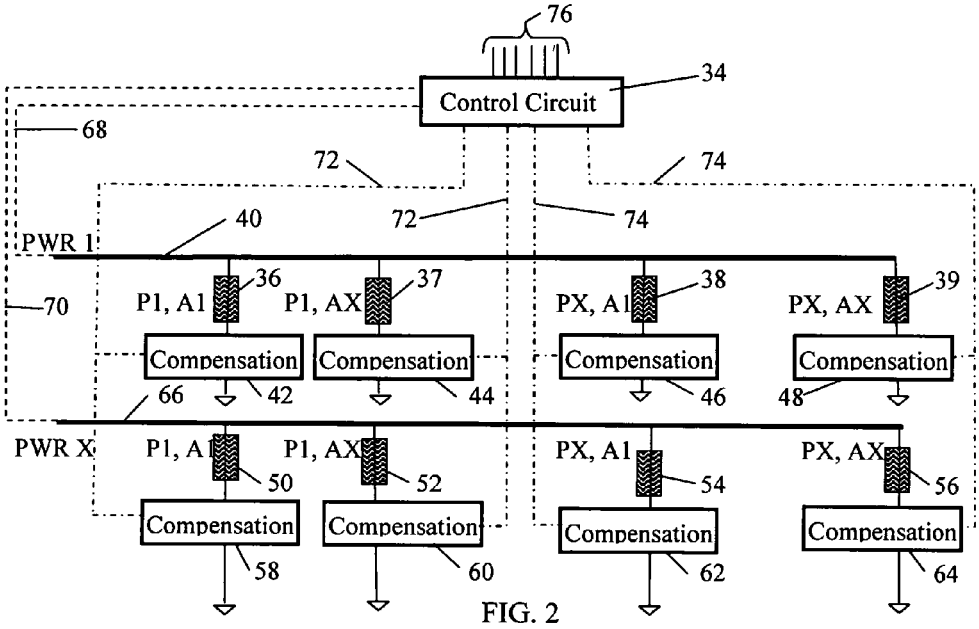
FIG. 2 is a schematic diagram illustrating the operation of the printhead control circuit, power circuit, and compensation circuits.

Referring now to FIG. 2, details of the printhead 22 are shown. The printhead 22 includes a control circuit 34 that functions to control the operation of ink ejectors 36–39 and 50–56 and of the compensation circuits 42–48 and 58–64 that are connected to the ink ejectors. The ink ejectors 36–39 are connected to a power line 40, which is also illustrated in the figure to as PWR 1 to illustrate that it is the first power line. The ejectors and 50–56 are connected to power line 66, which is also designated PWR X to illustrate that it is the last power line in a series of a power lines used in the printhead 22. Although only two power lines are illustrated, it will be understood that this schematic diagram illustrates any number of a plurality of power lines. Likewise, even though only eight ink ejectors 36–39 and 50–56 are illustrated and only eight compensation circuits 42–48 and 58–64 are illustrated, this schematic diagram is intended to illustrate an ink jet printer having any number of ink ejectors and compensation circuits.

In FIG. 2, power line 40 is shown connected to the controller 34 through line 68 and power line 66 is likewise connected to the controller 34 through power line 70. Lines 68 and 70 are shown as dashed lines to indicate that the power lines may or may not be fed through the control circuit 34. If the lines 68 and 70 are provided by the control circuit 34, the circuit 34 may also switch power lines on and off to provide a dimension of control and addressing. Alternatively, the power lines 68 through 70 could be constantly on or they could be switched by control circuits in the printer assembly 20 (FIG. 1) or in other portions of the printhead 22 (FIG. 1).

In operation, the control circuit 34 receives data signals and other signals through lines 76 that are provided by the tab circuit 26 shown in figure one. The data signals provided on lines 76 correspond to the object to be printed. The control circuit responds to those data signals by actuating the ink ejectors that will print a portion of the object. Printhead command signals are produced by the control circuit 34 and supplied to the compensation circuits 42–48 and 58–64 by control lines 72 and 74. The compensation circuits switch on to actuate an ink ejector to which the compensation circuit is connected. In addition to the function of actuating the ink ejectors, the compensation circuits also change their resistance to compensate for changes in the effective parasitic resistance of the power lines 40, 68 and 66, 70. Effective parasitic resistance refers to the apparent or effective resistance of power lines 40, 68 and 66, 70 that appears between the ink ejectors 30–39 and 50–56 and the source of power that is provided by the printer electronics module 24. For example, as more ink ejectors on power line 40 are actuated simultaneously, the current in power line 40, 68 must increase. The resistance of the power line 40, 68 remains relatively constant with the increasing current, but the voltage drop across the resistance of power line 40, 68 will increase because more current is flowing. Thus, the effective or apparent resistance increases from the viewpoint of each ink actuator. To compensate for the increased effective resistance of the power lines, the control circuit 34 will cause the compensation circuits 42–48 and 58–64 to change their resistances and thereby compensate for the increased effective parasitic resistance of the power lines 66 and 40.

In one embodiment, the resistance of the compensation circuits is reduced in proportion to the number of ink ejectors in a defined group that are to be actuated. The defined groups are preferably dictated by the power lines. All ink ejectors connected to a particular power line are preferably within a defined group. Thus, ejectors 36–39 are within a defined group associated with power line and 40 and ink ejectors 50–56 are in a group associated with power line 66. The control circuit 34 "knows" which ink ejectors in a particular group will be actuated at the same time. Thus, in addition to sending printhead command signals to actuate the correct ink ejectors, the control circuit 34 also issues commands that will cause the compensation circuits to reduce their resistance according to the number of ink ejectors that will be fired. For example, if the group of ink ejectors 36–39 associated with power line 40 will have only ejector 36 actuated, a command signal will be sent to compensation circuit 42 instructing it to connect the ink ejector 36 to ground and thereby eject ink. Compensation circuit 42 will also be instructed to maintain its resistance at its highest level when actuating ejector 36 because a relatively small amount of current is flowing in power line 40 and, thus, the parasitic resistance is relatively low.

If, however, all four ejectors 36–39 are to be actuated, the control circuit 34 will "know" this and will issue commands causing the compensation circuits 42–48 to actuate the four ink ejectors 36–39 and also to lower their resistance to the lowest setting possible. When all four ink ejectors are actuated, the current flowing in power line 40 is relatively large and the effective parasitic resistance is relatively large, which means the voltage drop across the power line 40 is also relatively large. Thus, the voltage appearing at each of the ink ejectors 36–39 is reduced as compared to situations where fewer in ejectors are actuated. By lowering the resistance of the compensation circuits 42–48, the control circuit 34 has compensated for the increased effective parasitic resistance of the power lines.

The control circuit 34 is preferably a simple hard wired logic that almost instantaneously instructs the compensation circuits to actuate the ink ejectors and also instructs the compensation circuits to reduce their resistance if necessary. Likewise, the compensation circuits preferably instantaneously respond to the printhead command signals. However, in alternate embodiments the logic and electronics of both the control circuit 34 and of the compensation circuits 42–48 and 58–64 could be more complicated devices. For example, the control circuit 34 and all or part of the compensation circuits could be implemented in a microprocessor, an ASIC, or in a device such as a programmable gate array.

The control circuit 34 may also receive input from the sensor 32 shown in FIG. 1 that senses environmental conditions. Based on the input from sensor 32, the circuit 34 may change the operation of the compensation circuits. For example, if the temperature of the electronics module 28 exceeded a predetermined threshold, the control circuit 34 would respond by causing the compensation circuits to decrease their resistance by a predetermined amount. Thus, the control circuit 34 would adjust the resistance of the compensation circuits to compensate for both temperature and the number of ejectors that will be actuated. For example, if actuators 36, 37 and 38 are to be actuated, the compensation circuits 42, 44 and 46 might normally be instructed to reduce their resistance by X amount. However, since the circuit 34 has determined that the temperature exceeds the threshold, circuit 34 instructs the compensation circuits 42, 44 and 46 to reduce their resistance by X plus Y amount thereby compensating for both temperature and the number of ink ejectors that are powered by line 40 and that are simultaneously actuated.

In addition, the control circuit 34 may respond to other parameters that it monitors or determines or that have been determined externally. For example, modules 24 or 28 may determine other parameters and provide signals based on those other parameters. The control circuit 34 then responds to these other parameters to cause the compensation circuits 36–39, 58–64 to adjust their resistance. For example, if the operating time exceeds a threshold or if the amount of ink exceeds a threshold, the control circuit 34 may cause the compensation circuits 42–48, 58–64 to reduce their resistance.

Figure 3:
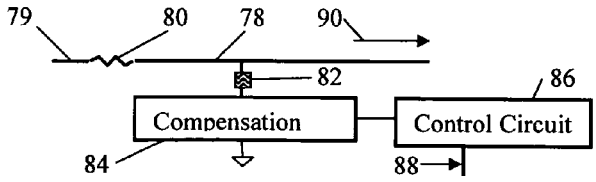
FIG. 3 is a schematic diagram of a single compensation circuit connected to an ink ejector and a controller.

Referring now to FIG. 3 a schematic diagram illustrates a power line 78 connected to power an ink ejector 82 when a compensation circuit 84 connects the actuator 82 to ground. The compensation circuit 84 operates under the control of a control circuit 86 that receives power, data, control and other signals on line 88. In response to the data signals, the control circuit 86 turns the compensation circuit 84 on and off to selectively actuate the ink ejector 82 and also controls the compensation circuit 84 so that it will adjust its internal resistance when actuating the ink ejector 82. In this illustration, a resistor 80 is shown to represent all of the parasitic resistance associated with the power line 78. The power line 78 is also connected to other ejectors that are not shown and when those ink ejectors are fired, current will flow down the power line 78 as indicated by arrow 90. Thus, as more ink ejectors are actuated, there will be an increased current flow in the power line 78 in the direction indicated by arrow 90. With the increased current flow, the voltage drop across the parasitic resistance 80 will increase. Assuming the power supply of the printer assembly 20 maintains a constant voltage on line 78 at node 79, the voltage applied to the ink ejector 82 will decrease as the total current carried by line 78 increases.

There is also a voltage drop across the compensation circuit 84 when it is turned on to actuate the ink ejector 82. By reducing the resistance of the compensation circuit 84, the voltage drop across the compensation circuit 84 decreases so that the voltage drop across the ink ejector 82 will remain relatively constant or stable even though the voltage applied by power line 78 to the ink ejector 82 is reduced. Ideally, the reduced voltage drop across the compensation circuit 84 will be designed to precisely compensate for the reduced voltage appearing at the node 79 on line 78. For example, if the voltage at node 79 drops 0.1 V then the resistance of the compensation circuit 84 would be reduced so that the voltage drop across compensation circuit 84 is reduced by 0.1 V, thereby perfectly compensating for the reduced voltage at node 79.

Figure 4:
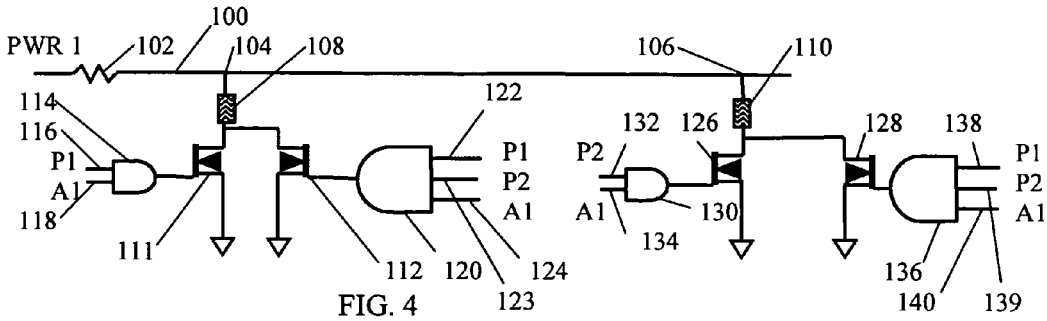
FIG. 4 illustrates two ink ejectors connected to a power line with each ink ejector connected to a pair of parallel switches that are used to actuate the ink ejector.

Referring to FIG. 4, a power line 100 is shown that corresponds to power line 40 in FIG. 2. This schematic diagram illustrates one embodiment of a compensation circuit that may be used with ink ejectors to reduce the resistance of the circuit that powers the ink ejector. In FIG. 4, resistor 102 represents the parasitic resistance of the power line 100, and ink ejectors 108 and 110 are connected to the power line 100 at Nodes 104 and 106. The ejectors 108 and 110 are connected to grounds through switches. Switches 111 and 112 connect ejector 108 to ground and switches 126 and 128 connect ejector 110 to ground. (As used herein, ground will be understood to mean a common reference voltage and it is not necessarily 0 voltage or equal to a ground external to the printhead.) Preferably switches 111–128 are field effect transistors but they may be other types of controllable switching devices. A logic AND gate 114 is connected to the switch 111 to turn it on and off. Input lines 116 and 118 are connected to the input of the AND gate 114, and both input lines must become active before the AND gate 114 will actuate the switch 111. Data signals are applied to lines 116 and 118 to selectively actuate the gate 114 and the switch 111. In this example, address signals P1 and A1 are applied to the lines 116 and 118. P1 and A1 represent address signals from two different dimensions of a multi-dimensional addressing system. P1 is the first position or bit in the P dimension and A1 is the first position or bit in the A dimension. Thus, if both P1 and A1 are active, the switch 111 will turn on and actuate the ink ejector 108.

The ejector 108 is also connected to a switch 112 which is connected to ground and is connected in parallel with the switch 111. A logic AND gate 120 is connected to control the switch 112, and the input lines 122, 123 and 124 of the gate 120 are connected to receive these addressing signals, namely, P1, P2 and A1. Following the same nomenclature as described before, P1 and P2 are the first and second positions or bits in the P dimension. Thus, if P1, P2 and A1 are active, the gate 120 will actuate the switch 112 and also actuate the actuator 108. Thus, when the printhead is instructed to actuate the two ink ejectors associated with the address positions P1, A1 and P2, A1; the switches 111 and 112 will simultaneously turn on and both will actuate the ink ejector 108. The parallel connection of the two switches 111 and 112 will produce a reduced resistance between the actuator 108 and ground causing a reduced voltage drop between the actuator 108 and ground. Thus, even if the voltage drops on the power line 100 at the node 104 because of an increased effective parasitic resistance 102, the voltage drop across the actuator 108 may remain relatively constant. Alternatively, turning on both switches 111 and 112 will at least partially compensate for reduced voltage at node 104.

The compensation circuit for the ink ejector 110 is similar to the compensation circuit previously described with regard to FIG. 4. The ejector 110 is connected to parallel switches 126 and 128 which are both connected to ground and are controlled by AND gates 130 and 136, respectively. The address signals P2 and A1 are applied to the input lines 132 and 134 of gate 130, and the address signals P1, P2 and A1 are applied to the input lines 138, 139 and 140 of the gate 136. In this construction, the actuator 110 will be actuated by two switches 126 and 128 when the ejectors associated with the addresses P2, A1 and P1, A1 are instructed to fire simultaneously. Again, the parallel switches 126 and 128 have a reduced resistance as compared to switch 126 by itself.

Figure 5:
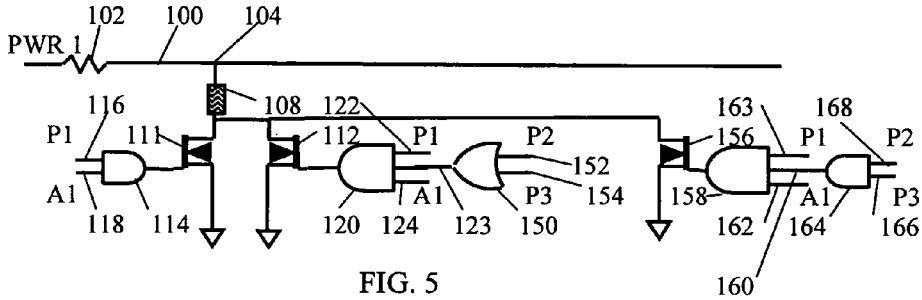
FIG. 5 illustrates an ink ejector connected to a power line and also connected to three parallel switches that are used to actuate the ink ejector.

Referring now to FIG. 5, there is shown a variation of the circuit diagram in FIG. 4. In FIG. 5, an additional switch 156 has been added in parallel with the switches 112 and 111. The control of switch 111 has been unchanged, but the control of switch 112 has been changed by adding an "Or" gate whose inputs 152 and 154 are connected to receive address signals P2 and P3. Thus the input on line 122 is active if either P2 or P3 are active.

This switch 156 is controlled by the AND gate 158 whose input line 162 is connected to receive the address signal A1 and whose input line 160 is connected to the output of an AND gate 164, whose inputs 166 and 168 are connected to address signals P2 and P3, respectively. Thus, the output on line 160 will be active only if both P2 and P3 are active, and the AND gate 158 will actuate and be active only if P1, P2 and P3 are active and A1 is active.

In operation, if data signals require only that the ink ejector 108 be fired, P1 and A1 will become active and the actuator 108 will be fired with only switch 111. However, if the data signals require that two ejectors be actuated, such as the actuators associated with P1, A1 and P2, A1, then ejector 108 will be fired by two switches, namely, switches 111 and 112. In this example, it will be understood that the actuators associated with the two addresses P1, A1 and P2, A1 are both powered by the same power line, such as power line 100. If the actuator associated with the position P3, A1 is to be fired in addition to the actuator 108, the switch 112 will again become active because the signal P3 is connected to the OR gate 150 which will apply an active signal to the input 123, which along with the active signal on lines 122 and 124 will activate the AND gate 120, and the switch 112 will be turned on. Finally, if the data signals activate the three ejectors associated with the positions P1, A1; P2, A1 and P3, A1; then all three switches 111, 112 and 156 will turn on and actuate the ink ejector 108. Again, it will be understood that all three ink ejectors in this example are powered by the same power line.

The logic illustrated in FIG. 5 applies to a specific printer where three ink actuators associated with address positions P1, A1; P2, A1 and P3, A1 are powered by the same power line. However, the logic illustrated by FIG. 5 could be expanded to any number of actuators associated with a particular power line. For example, if a particular power line powered 100 ejectors, then a 100 parallel switch could be associated with each ejector so that the number of switches actuating an ejector could equal the number of ejectors in the group that is being actuated. However, as a practical matter, only a limited number of ink ejectors associated with a particular group of ejectors are allowed to fire at the same time. Thus, for example, if a particular printer imposed a limitation requiring that a maximum of eight ejectors associated with a particular power line may be fired simultaneously, then each ejector could have only eight switches connected to it. In such case, the number of switches firing an ejector could still equal the number of the ejectors in a group that are being fired simultaneously. Again, AND/OR logic may be implemented as shown in FIG. 5 to cause the number of active switches to equal the number of active ink ejectors in a pre-defined group, such as the ejectors associated with a particular power line.

Figure 6:
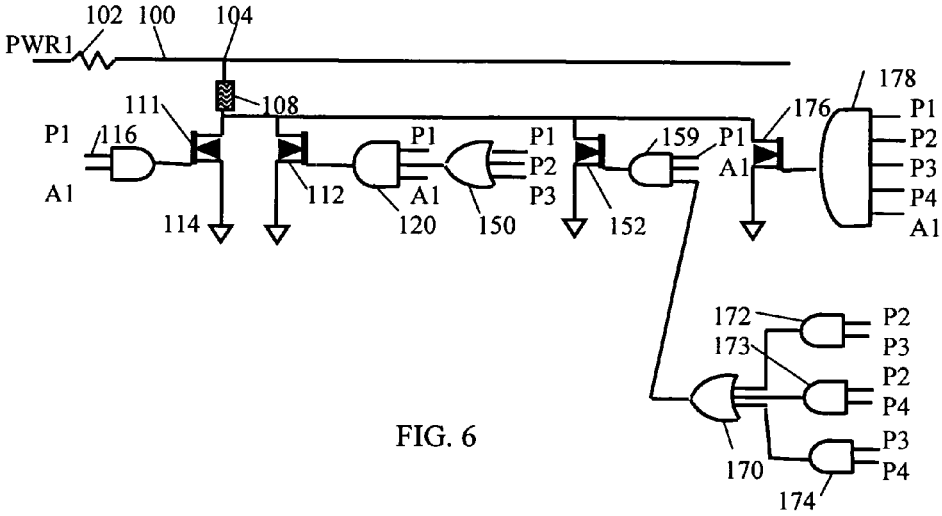
FIG. 6 illustrates an ink ejector connected to a power line and also connected to a plurality of parallel switches that are used to actuate the ink ejector.

Referring now to FIG. 6, a circuit diagram is shown of a circuit having four compensation circuits illustrating simple logic for matching the number of active switches to the number of active ejectors within a defined group. In this circuit, there are four switches 111, 112, 152, and 176 connected to actuate the ink ejector 108, and there are four possible P dimension signals P1–P4. As before, switch 112 is controlled by AND gate 120 whose inputs are P1, A1 and the output of an OR gate 150. Signals P2, P3 and P4 are applied as inputs to the OR gate 150 so that switch 112 is activated when P1 and A1 are active and when any one of the remaining P signals (P2–P4) are active. Switch 152 is controlled by the AND gate 159 whose inputs are connected to receive P1 and A1 and the output of an OR gate 170. The inputs of the OR gate 170 are connected to the outputs of AND gates 172, 173 and 174, respectively. The AND gate 172 has two inputs that are connected to signals P2 and P3, the AND gate 173 has two inputs P2 and P4, and the AND gate 174 has two inputs connected to signals P3 and P4. In this configuration, switch 152 will be activated (turned on) when P1 and A1 are active and any two of the remaining P signals are active. Finally, switch 176 is controlled by AND gate 178 whose inputs are connected to A1 and all of the P signals, namely P1–P4. Thus, switch 176 will be activated when A1 is active and all four of the P signals are active, namely, signals P1–P4. Thus, the ejector 108 will be actuated with a number of switches that is equal to the number of active ink ejectors within the group of ink ejectors which are connected to power line 100. Again, it will be appreciated that this concept can be expanded to control any number of switches per ink ejector for any number of ejectors in a group.

Figure 7:
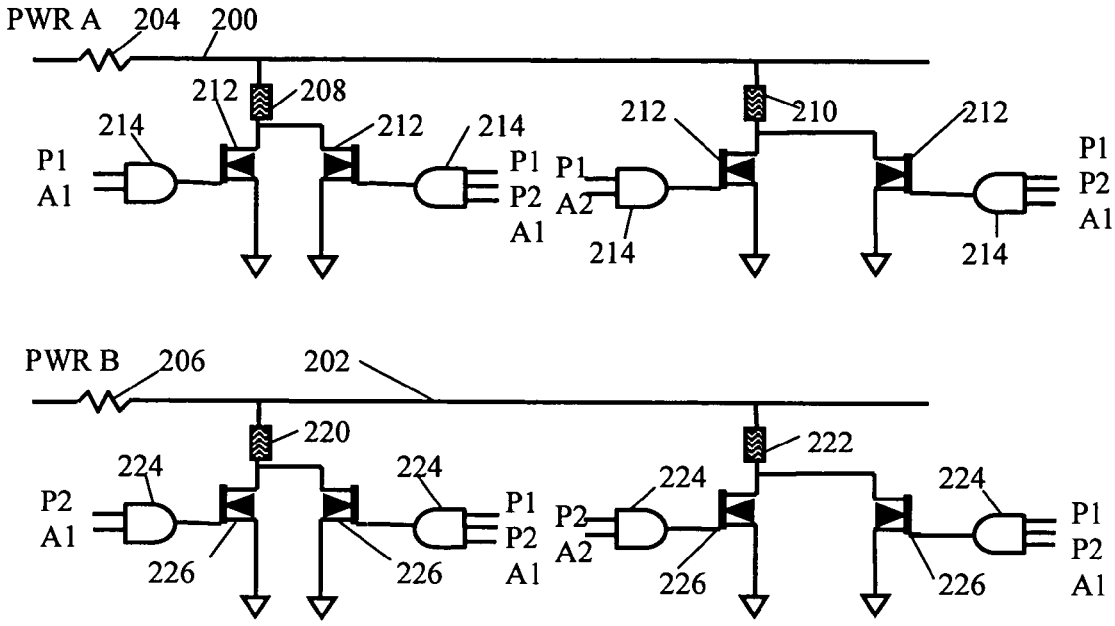
FIG. 7 illustrates two groups of ink ejectors with each group connected to a different power line and each ink ejector connected to a compensation circuit; the FIG. 8 illustrates a printhead in which the ink ejectors are actuated based upon data signals and the output of a first type of counter.

In FIGS. 4–6, only one power line was illustrated for a particular ink jet printer and these power lines were simplistic in that numerous ink ejectors were omitted and simplified addressing schemes were described. It will be understood that actual printheads typically will have many more power lines and ejectors and more complicated multidimensional addressing systems. FIG. 7 is provided to illustrate the compensation circuits as described previously in connection with a simplistic printhead having multiple power lines. Again for purposes of easy discussion and illustration, the number of ejectors has been reduced dramatically and the number of power lines has been reduced. In actual construction, a practical printhead would have numerous ejectors associated with each power line and would have numerous power lines. The printhead schematically illustrated in FIG. 7 has two power lines 200, 202 with parasitic resistances illustrated by resistors 204 and 206 respectively. In this simplified printhead, ejectors 208 and 210 are connected to power line 200 and are actuated by switches 212 which are controlled by logic gates 214. Similarly, ink actuators 220 and 222 are actuated by switches 224 that are controlled by logic gates 226. All switches and ink actuators function in the manner described above with respect to FIG. 4. In this example, ejectors 208 and 210 are defined as one group associated with power line 200, and ejectors 220 and 222 are defined as another group associated with power line 202. In the preferred embodiment, the compensation circuits are controlled by a logic that only concerns itself with the number of ejectors within a single group that are actuated simultaneously. Thus, for example, if ink ejector 208 is actuated alone, only one switch 212 is used. However, if the ejectors 208 and 210 are actuated simultaneously, each ejector 208 and 210 is actuated by two switches 212.

The logic described previously may be configured so that groups are defined differently. For example, the logic could be configured so that ink ejector 208 is actuated by two switches 212 only if ejector 220 is actuated simultaneously. Similarly the logic could be configured so that actuator 208 is actuated by two switches 212 only if ejectors 208, 210, 220, 222 are actuated simultaneously. In both of these examples, the defined groups extend between ejectors associated with different power lines. However, such logic would not be the preferred embodiment and preferably a group of ejectors is defined by the power line to which the group is attached.

Figure 8:
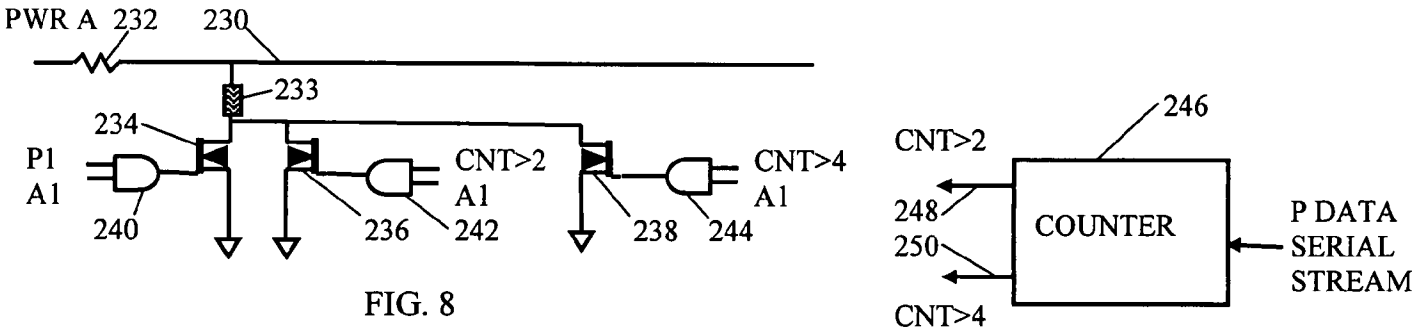

An alternate embodiment of the invention is shown in FIG. 8 in which the number of switches does not equal the number of active ejectors in a defined group. In this embodiment, a power line 230 has a parasitic resistance 232 and is attached to power an ink ejector 233. The ink ejector is connected to ground through three parallel switches 234, 236 and 238 that are controlled by logic gates 240, 242 and 244. Each switch is preferably an FET and each logic gate is preferably an AND gate. Ink ejector 233 is associated with the address P1, A1, and when both the P1 and A1 signals are present, the logic gate 240 turns on or is active producing a signal at its output that is applied to the gate of the switch 234. When actuated by the gate 240, the switch 234 turns on and actuates the ink ejector 232.

The second switch 236 is controlled by a gate 242 whose inputs are attached to receive the address signal A1 and a signal, CNT>2. The signal CNT>2 will be active when the number of active address signals within a defined group and within a given period of time or cycle exceeds two. Thus, if the address signal P1, A1 is active and two other P address signals are active, then the total count of P signals will be 3, which is greater than 2, and the CNT>2 signal will become active. Thus, the gate 242 will actuate the switch 236 which will actuate the ink ejector 233.

The switch 238 is controlled by logic gate 244 whose inputs are connected to receive the signal A1 and the signal CNT>4. If the number of active P address signals is greater than 4, the signal CNT>4 will be active. Thus, if the A1 signal is active and the number of active P address signals is greater than four, then the switch 238 will turn on and actuate the ejector 233. Thus, the number of switches that actuate the ink ejector 233 is proportional to the number of active ejectors associated with the power line 230 at a given time, but the number of active switches is not equal to the number of active ejectors.

To provide the two signals, count>2 and count>4, a counter 246 is provided and it receives the P data stream. In a particular firing cycle (actuating cycle), the counter 246 will count the number of active ejectors for each power line. In the circuit of FIG. 8, it is assumed that the power on line 230 is constant and that all ejectors associated with the signal P address are connected to the power line 230. Therefore, by counting the number of P addresses that are active in a single firing cycle, the counter 246 determines the number of ejectors associated with power line 230 that will be fired during a particular cycle. If the count is greater than two, the signal on line 248 is made active and if the count is greater than four, the signal on line 250 is made active. These signals are applied to the gates 242 and 244 in the manner previously described and as shown in figure eight.

Figure 9:
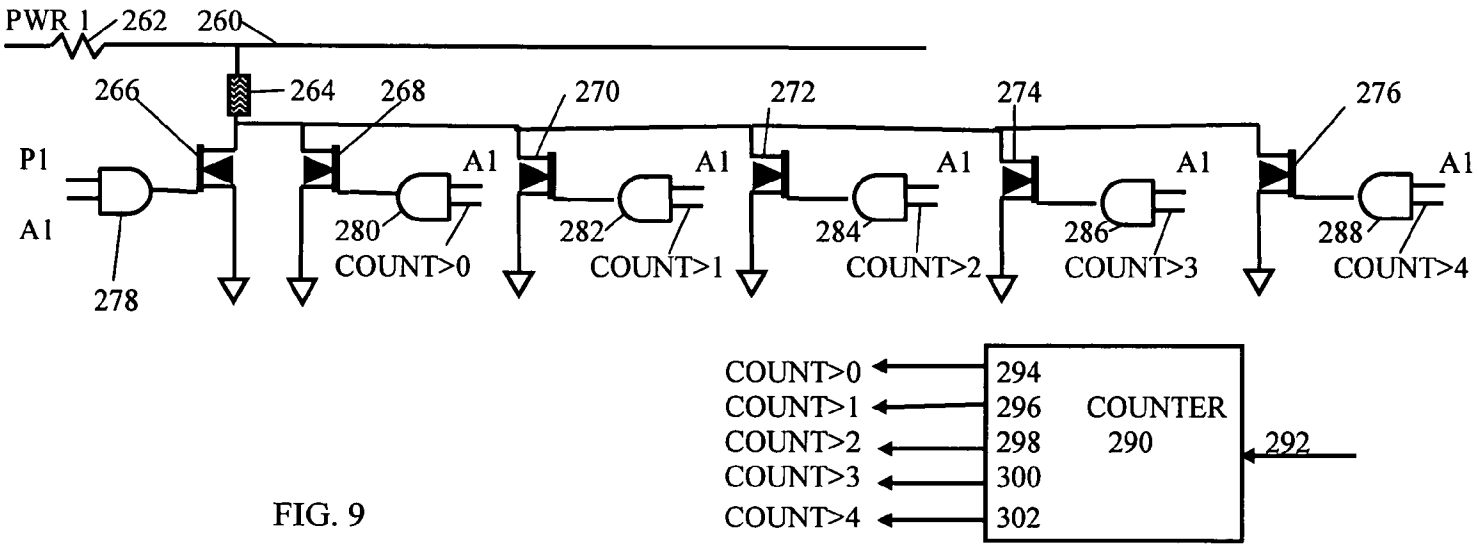
FIG. 9 illustrates a printhead in which the ink ejectors are actuated based upon the data signals and the output of a second type of counter.

FIG. 9 shows another alternate embodiment in which the number of active switches is proportional to and greater than the number of active ejectors in a defined group. In this case, a minimum of two switches are used to actuate an ejector, and the number of active switches is always one greater than the number of active ejectors associated with a defined group.

In this embodiment, a power line 260 has a parasitic resistance 262 and is connected to power an ejector 264. Each ejector in the printhead will be connected in a manner similar to that shown in FIG. 9. The ejector 264 is connected to ground through a parallel connection of six switches 266, 268, 270, 272, 274 and 276. Switch 266 is controlled so that it will be active and actuate the ejector 264 when the signals P1 and A1 are active. Switch 268 is connected to actuate ink ejector 264 when the A1 signal is active and the number of P signals is greater than 0. Likewise, gate 282 will actuate switch 270 when the P count is greater than one and the signal A1 is present. Gates 284, 286 and 280 actuate switches 272, 274 and 276, respectively, when the signal A1 is present and the count of P signals is greater than two, three and four, respectively. Thus, the number of active switches is equal to one plus the count of P signals that occur in a particular firing cycle.

A counter 290 receives on line 292 the P data serial stream and is able to determine the number of active ink ejectors for each power line. In this simplified example, the counter is shown to produce only 5 counts (count>0 through court>4) for one power line. However, the counter 290 will produce a count for each power line, or a separate counter may be provided for each power line. Thus, the ejectors associated with all power lines are controlled in the same manner. The counter 290 produces its output signals on output lines 294–302, and those signals (count>0 through count>4) are applied to the gates 280–288 as described above.

In the examples given above, the counter determines of the number of active ejectors associated with a defined group of ejectors, and that group is preferably defined by the power line to which the ejectors are attached. However, similar logic, or the same logic, could be applied to ejectors of different power lines. That is, a defined group would include switches attached to different power lines. Also, as demonstrated by the above examples, compensation may be provided for any number of simultaneous fires per group.

While certain specific examples have been described above to illustrate the invention, it will be understood that the invention is capable of numerous arrangements, modifications and substitutions of parts without departing from the scope of the invention as defined in the claims.

What is claimed is:

1. A printhead for an ink jet printer responsive to control and data signals, comprising:

a plurality of ink ejectors for ejecting ink when actuated;

a power circuit for selectively applying power to ink ejectors to actuate the ink ejectors and eject the ink;

a control circuit responsive to the data signals for producing control signals for controlling the operation of the power circuit to actuate the selected ejectors based on the data signals;

the power circuit having a total resistance and including a compensation circuit having a sub-total resistance included in the total resistance and being controlled by the control circuit for reducing the total resistance of the power circuit in response to the control signals, the compensation circuit having first and second parallel resistance paths and being responsive to the control signals to connect either the first resistance path or both the first and second resistance path to carry power in the power circuit, whereby the sub-total resistance of the compensation circuit is reduced when both the first and second resistance paths are connected to carry power.

2. The printhead of claim 1 wherein at least one of the compensation circuits is connected to each one of the ink ejectors and each of the compensation circuits comprises:

a first switch in the first parallel resistance path having a first internal resistance and being connected to actuate an associated one of the ink injectors when the first switch is turned on;

a second switch in the second parallel resistance path having a second internal resistance and being connected to actuate the associated ink ejector when the second switch is turned on, said first and second switches being connected in parallel with each other; and said control circuit being interconnected with said first and second switches for selectively actuating the associated ink ejector by either (1) switching the first switch on or (2) switching the first and second switches on, whereby the resistance of the compensation circuit may be reduced by switching both the first and second switches on as compared to switching on only the first switch.

3. The printhead of claim 1 wherein each compensation circuit comprises:

said ink ejectors being disposed in groups;

a first switch having a first internal resistance and being connected to actuate one associated ink injector when the first switch is turned on;

a second switch having a second internal resistance and being connected to actuate the associated ink ejector when the second of switch is turned on, said first and second switches being connected in parallel with each other; and said control circuit being connected to selectively turn on the first and second switches, said control circuit being responsive to the data signals to actuate the first switch when only one of the ink ejectors within on of the groups is required to be actuated by the data signals, and to actuate both the first and second switches when a number, more than one, of the ejectors in one of the groups is required to be actuated by the data signals.

4. The printhead of claim 1 wherein each compensation circuit comprises:

X number of switches connected in parallel with each other and connected to actuate an associated ink ejector;

said control circuit being connected to control the X number of switches and to selectively actuate the switches said control circuit being responsive to the data signals to actuate a select number of the X number of switches based upon the data signals.

5. The printhead of claim 4 wherein the select number of switches actuated by the control circuit is proportional to the number of ink ejectors required to be actuated by the data signals substantially simultaneously within one of the groups.

6. The printhead of claim 4 wherein the select number of switches actuated by the control circuit is proportional to the number of ink ejectors required to be actuated by the data signals substantially simultaneously within one of the groups.

7. The printhead of claim 4 wherein the select number of switches actuated by the control circuit is equal to the number of ink ejectors required to be actuated by the data signals substantially simultaneously within one of the groups.

8. A printer comprising:

a main printer assembly including printer electronics, a media carrier, and a printhead carrier, the printer electronics for producing power signals, control signals and data signals, the data signals corresponding to an object to be printed;

a circuit connected to receive the power signals, control signals and data signals from the printer electronics;

a printhead mounted on the printhead carrier and connected to the circuit for receiving the power signals, the control signals and the data signals;

a plurality of ink ejectors disposed in the the printhead for ejecting ink when actuated;

a printhead control circuit disposed in the printhead for receiving at least the data signals, logic in the printhead control circuit for receiving at least the data signals and producing printhead command signals based on the data signals;

a power circuit for actuating the ink ejectors in response to the printhead command signals, the power circuit including a plurality of compensation circuits for receiving the printhead command signals, each ink ejector being associated with a single one of the compensation circuits, each of the compensation circuits at least first and second switches that are connected in parallel with each other, each of the switches in a single one of the compensation circuits being connected to actuate a single associated one of the ink ejectors when the switch is turned on, each of the compensation circuits being responsive to the printhead command signals to actuate either the first switch or the first and second switch in the compensation circuit to actuate the associated ink injector and eject the ink.

9. The printer of claim 8 wherein the logic is configured to actuate only one switch of the X number of switches in one of the compensation circuits to actuate a particular one of the ink ejectors when the following conditions exist: (1) the particular ink ejector is associated with a particular one of the power signals and (2) only one of the ink ejectors associated with the particular power signal will be actuated in a predetermined time interval based on the data signals.

10. The printer of claim 8 wherein the logic is configured to determine a select number and actuate the select number of switches of the X number of switches in one of the compensation circuits to actuate the particular ink ejector, the select number being based upon: (1) the particular power signal with which the particular ink ejector associated, and (2) the number of the ink ejectors associated with the particular power signal that will be turned on in a predetermined time interval based on the data signals.

11. The printer of claim 8 wherein the logic is configured to actuate a plurality of the X number of switches in one of the compensation circuits to actuate a particular ink ejector when the following conditions exist: (1) the particular ink ejector is associated with a particular power signal and (2) a plurality of the ink ejectors associated with the particular power signal will be turned on in a predetermined time interval based on the data signals.

12. The printer of claim 8 wherein the logic is configured to actuate Y number of switches of the X number of switches in one of the compensation circuits to actuate a particular ink ejector when the following conditions exist: (1) the particular ink ejector is associated with a particular power signal and (2) a Y number of the ink ejectors associated with the particular power signal will be turned on in a predetermined time interval based on the data signals.

13. A printer for printing objects comprising:

a main printer assembly including printer electronics, a media carrier, and a printhead carrier, the printer electronics for producing M number of power signals, control signals and data signals, the data signals corresponding to one of the objects to be printed and being configured in a plurality of address dimensions, the data signals including at least Y number of first dimension signals and Z number of a second dimension signals, a circuit connected to receive the power signals, control signals and data signals from the printer electronics;

a printhead mounted on the printhead carrier and connected to the circuit for receiving the power signals, the control signals and the data signals;

a plurality of ink ejectors disposed in the the printhead for ejecting ink, each ink ejector being uniquely identified with a unique combination of the power signals, the first dimension signals and the second dimension signals, each power signal being associated with and providing power to a unique group of ejectors;

a printhead control circuit disposed in the printhead for receiving at least the data signals, logic in the printhead control circuit for receiving at least the data signals and producing printhead command signals based on the data signals;

a power circuit for actuating the ink ejectors in response to the printhead command signals, the power circuit including a plurality of compensation circuits for receiving the printhead command signals, each ink ejector being associated with a single one of the compensation circuits, each of the compensation circuits including X number of switches that are connected in parallel with each other, each switch in a single compensation circuit being connected to actuate a single associated ink ejector when the switch is turned on, each compensation circuit being responsive to the printhead command signals to actuate a number of switches in the compensation circuit to actuate the associated ink injector and eject the ink.

14. The printer of claim 13 wherein the logic is configured for determining a number of switches to be turned on in a predetermined time interval in a particular one of the compensation circuits based upon (1) the power signals, (2) the particular unique groups of ink ejectors associated with the power signals, and (3) the number of ink ejectors within one of the unique group that are required by the data signals to actuate within the predetermined time interval.

15. The printer of claim 13 wherein the logic is configured for causing the X number of switches to be turned on in a predetermined time interval in a particular one of the compensation circuits where: (1) the particular compensation circuit is within a particular group of compensation circuits, (2) the particular group of compensation of circuits is associated with a particular group of ink ejectors, (3) the particular group of the ink ejectors is associated with a particular one of the power signals, and (4) X is proportional to the number of ink ejectors within the particular group of ink ejectors that are required by the data signals to actuate within the predetermined time interval.

16. The printer of claim 13 wherein the printhead control circuit further comprises logic for causing the X number of switches to be turned on in a predetermined time interval in a particular compensation circuit where: (1) the particular compensation circuit is within a particular group, (2) the particular group of compensation of circuits is associated with a particular group of ink ejectors, (3) the particular group of the ink ejectors is associated with a particular power signal, and (4) X is equal to the number of ink ejectors within the particular group of ink ejectors that are required by the data signals to actuate within the predetermined time.

17. The printer of claim 13 wherein:

there are at least A and B of the power signals, at least two of the first dimension address signals (P1 and P2), and at least two of the second dimension address signals (A1 and A2), and wherein the power circuit further comprises a first power line for connecting a first group of the ink ejectors to the A power signal and a second power line for connecting a second group of the ink ejectors to the B power signal;

and wherein the control circuit further comprises:

a first AND gate connected to receive the P1 first dimension address signal and the A1 second dimension address signal and produce a first output signal;

a second AND gate connected to receive the P1 and P2 first dimension address signals and the A1 second dimension address signal and produce a second output signal;

a third AND gate connected to receive the P2 first dimension address signal and the A1 second dimension address signal to produce a third output signal;

a fourth AND gate connected to receive the P1 and P2 first dimension address signals and the A1 second dimension address signal to produce a fourth output signal;

a fifth AND gate connected to receive the P1 first dimension address signal and the A2 second dimension address signal and produce a fifth output signal;

a sixth AND gate connected to receive the P1 and P2 first dimension address signal and the A2 second dimension address signal and produce a sixth output signal;

a seventh AND gate connected to receive the P2 first dimension address signal and the A2 second dimension address signal to produce a seventh output signal;

an eighth AND gate connected to receive the P1 and P2 first dimension address signals and the A2 second dimension address signal to produce an eighth output signal;

and wherein the ink ejectors and the power circuit further comprise at least four ink ejectors (herein designated as ejector X where X indicates an ejector number(s) or range of ejector numbers) and eight switches (herein designated as switch(es) X where X is a switch number(s) or range of switch numbers), ejectors 1, 2, 3, 4 being connected to switches 1&2, 3&4, 5&6, 7&8, respectively, where each switch will actuate one ink ejector to which it is connected, the switches 1–8 being connected to receive the first through the eighth output signals, respectively, with each of the switches being actuated by one of the output signals having a corresponding number, whereby the switches 1–8 are selectively actuated by the first through the eighth output signals;

and wherein the ink ejectors 1–2 are in the first group connected to the A power line and the ink ejectors 3–4 are in the second group connected to the B power line.

18. The printer of claim 13 wherein:

the power circuit further comprises M power lines for connecting M groups of ink ejectors (including the ejectors 1–4) to the M power signals;

and wherein the control circuit further comprises Q groups of logic gates (including the first AND gate through the eighth AND gate), each logic gate in a group being controlled by combinations of the first and second demension address signals, and wherein the ink ejectors further comprise at least Q ink ejectors arranged into M groups of ink ejectors;

and wherein the power circuit further comprises Q groups of switches (including switches 1–8) where each group of switches is connected to and controlled by one of the groups of logic gates, where each of the ink ejectors is connected to a single group of switches, and each switch in a group will actuate the single ink ejector to which it is connected.

19. The printer of claim 13 wherein the control circuit further comprises a counter circuit for counting ink ejectors in each group of ink ejectors that are to be actuated in a particular time interval and producing a count for each group of ink ejectors, the logic gates being responsive to the counts for each group of ink jets to actuate a particular number of switches in each group of switches to actuate the ink ejectors, the particular numbers being based on the counts.

* * * * *

UNITED STATES PATENT AND TRADEMARK OFFICE

CERTIFICATE OF CORRECTION

PATENT NO. : 6,976,752 B2
APPLICATION NO. : 10/694697
DATED : December 20, 2005
INVENTOR(S) : George K. Parish et al.

It is certified that error appears in the above-identified patent and that said Letters Patent is hereby corrected as shown below:

Col. 13 Claim 2, line 6, replace “injectors” with --ejectors--.

Col. 13 Claim 3, line 26, replace “injector” with --ejector--; line 31, delete “of”, and line 37, replace “on” with --one--.

Col. 14 Claim 8, line 12, delete the second occurrence of the word “the”; line 24, insert --comprising-- between “circuits” and “at”; and line 34, replace “injector” with --ejector--.

Col. 14 Claim 10, line 48, insert --is-- between “ejector” and “associated”.

Col. 14 Claim 13, line 16, delete the second occurrence of the word “the”; and line 41, replace “injector” with --ejector--.

Col. 17 Claim 18, line 9, replace “demension” with --dimension--.

Signed and Sealed this

Tenth Day of April, 2007

JON W. DUDAS
*Director of the United States Patent and Trademark Office*